US007932673B2

(12) United States Patent
Schleimann-Jensen et al.

(10) Patent No.: US 7,932,673 B2
(45) Date of Patent: Apr. 26, 2011

(54) GAS DISCHARGE TUBE

(75) Inventors: Johan Schleimann-Jensen, Danderyd (SE); Jan-Ake Nilsson, Sollentuna (SE); Arne Schleimann-Jensen, Sollentuna (SE)

(73) Assignee: Jensen Devices AB, Sollentuna (SE)

( * ) Notice: Subject to any disclaimer, the term of this patent is extended or adjusted under 35 U.S.C. 154(b) by 202 days.

(21) Appl. No.: 12/124,552

(22) Filed: May 21, 2008

(65) Prior Publication Data

US 2009/0102377 A1 Apr. 23, 2009

(30) Foreign Application Priority Data

May 22, 2007 (SE) ..... 0701246

(51) Int. Cl.
*H01J 11/00* (2006.01)

(52) U.S. Cl. ..... 313/567

(58) Field of Classification Search ..... 313/567
See application file for complete search history.

(56) References Cited

U.S. PATENT DOCUMENTS

| | | | | |
|---|---|---|---|---|
| 2,050,397 | A | 8/1936 | Torok | |
| 2,103,159 | A | 12/1937 | Kingdon | |
| 4,407,849 | A | 10/1983 | Haas et al. | |
| 4,437,845 | A | 3/1984 | Schleimann-Jensen | |
| 4,672,259 | A | 6/1987 | Riggins et al. | |
| 5,103,135 | A | 4/1992 | Lange et al. | |
| 5,491,381 | A * | 2/1996 | Idei et al. | 313/589 |
| 6,655,986 | B2 * | 12/2003 | Kroll | 439/534 |
| 7,053,536 | B1 * | 5/2006 | Boman et al. | 313/231.11 |

FOREIGN PATENT DOCUMENTS

| | | |
|---|---|---|
| EP | 1149444 | 3/2006 |
| WO | WO 0039901 A1 * | 7/2000 |

* cited by examiner

*Primary Examiner* — Nimeshkumar D Patel
*Assistant Examiner* — Jacob Stern
(74) *Attorney, Agent, or Firm* — Gauthier & Connors LLP

(57) ABSTRACT

A new gas discharge tube comprising at least two electrodes and at least one hollow insulator ring fastened to at least one of the electrodes, wherein the insulating ring has an extended length for a creeping current on at least one of the surfaces inside and/or outside compared to its height thereby providing a long distance to any possible creeping current.

16 Claims, 4 Drawing Sheets

GAS DISCHARGE TUBE

PRIORITY INFORMATION

The present application claims priority to Swedish Application No. 0701246-1, filed on May 22, 2007, which is incorporated herein by reference in its entirety.

DESCRIPTION

1. Technical Field

The present invention concerns the field of gas discharge tubes including surge arresters, gas arresters, high-intensity discharge tubes, spark gaps, switching spark gaps and triggered spark gaps, used in various applications, such as surge voltage protectors for communications networks voltage controlled switching of capacitive discharge circuits and in particular to a new type of such devices which exhibit higher selectivity, better performance and are more environmentally friendly. In particular the present invention relates to the design of an insulating part of such a gas discharge tube.

2. Background of the Invention

When electronic equipment is connected to long signal or power lines, antenna etc, it is exposed to transients generated by induction, caused by lightning or electromagnetic pulses (EMP). A surge arrester protects the equipment from damage by absorbing the energy in the transient or by connecting it to ground. Surge arresters are required to be self-recovering, able to handle repetitive transients and can be made fail-safe. An important property is the speed and selectivity of ignition, in other words, the surge arrester must function without delay and still not be so sensitive, that it is triggered by a normal communications signal. These properties should remain unchanged over time and irrespective of the ignition intervals. Further, a surge arrester should be suitable for mass production with high and uniform quality.

Gas-filled discharge tubes are used for protecting electronic equipment but are also frequently used as switching devices in power switching circuits, e.g. in beamers and automotive products such as gas-discharge headlights. Other application areas are tele and data communications, audio/-video equipment, power supplies, welding equipment, electronic igniters for gas heating and gas domestic appliances, eg cookers, industrial, medical devices, architectural, security and military applications.

Early surge arresters comprised two solid graphite electrodes, separated by an air-gap or a layer of mica. These are, however, not comparable to the modern surge arresters with respect to size, reliability, performance and production technology.

A modern conventional surge arrester is the gas filled discharge tube, which may have one or several discharge paths or discharge gap and usually comprises two end electrodes plus optionally one additional electrode in the form of a centre electrode plus one or two hollow cylindrical insulators, made of an electrically insulating material, such as a ceramic, a suitable polymer, glass or the like. As a rule, the insulator in a two-electrode surge arrester is soldered to the end electrodes at two sides, joining them hermetically.

One method of producing a conventional surge arrester is outlined, for example, in U.S. Pat. No. 4,437,845. According to U.S. Pat. No. 4,437,845, the manufacturing process consists of sealing at a suitable temperature the components of the tube at substantially atmospheric pressure in a light gas mixed with another gas which, in view of the intended function of the tube, is desirable and heavier than the first-mentioned gas, and reducing the pressure exteriorally of the tube below atmospheric pressure, while simultaneously lowering the temperature to such extent that the heavy gas can only to an insignificant degree penetrate the tube walls through diffusion and/or effusion, and the enclosed light gas can diffuse and/or be effused through the walls such that, as a result of the pressure difference, it will exit through the walls of the tube, thus causing a reduction in the total gas pressure inside the tube.

Further, an outside coating of the surge arrester components has been disclosed in U.S. Pat. No. 5,103,135, wherein a tin coating is applied to the electrodes, and an annular protective coating is applied to the ceramic insulator having a thickness of at least 1 mm. This protective coating is formed from an acid-resistant and heat-resistant colorant or varnish which is continuous in the axial direction of the surge arrester. The protective coating may form part of the identification of the surge arrester. For example, the identification may be in the form of a reverse imprint in the protective coating. In addition, tin-coated leads can be coupled to the electrodes.

U.S. Pat. No. 4,672,259 discloses a power spark gap for protection of electrical equipment against supervoltages and having high current capacity, which spark gap comprises two carbon electrodes each having a hemispherical configuration and an insulating porcelain housing, whereby the carbon electrodes contains vent holes to the inner thereof to provide arc transfer to an inner durable electrode material. The spark gap is intended for high voltage lines, wherein the expected spark length is about 2.5 cm (1 inch), transferring 140 kV or so. This spark gap is not of the type being hermetically sealed and gas filled, but communicates freely with the air. The arc formed starts from the respective underlying electrodes and passes the vent holes. Thus the formation of the spark is, to a great part, based on the underlying material, which is not necessarily inert, but is due to oxidation in the existing environment, which means that the spark voltage can not be determined, and reproduced.

U.S. Pat. No. 4,407,849 discloses a spark gap device and in particular a coating on the electrodes of such spark gap, in order to minimize filament formation. The coating is applied onto an underlying electrode, whereby the coating may consist of carbon in the form of graphite. The surge limiter is a gas filled one. The reference does not address the issue of having an inert surface or not on the electrode, or any problems related thereto.

U.S. Pat. No. 2,103,159 discloses an electrical discharge device having a long distance for any creeping current, which has been made by extending the height of the device between the electrodes including a wave formed envelope. Such a device does not meet the requirements of modern discharge devices.

U.S. Pat. No. 2,050,397 discloses another discharge device showing an extreme distance between the electrodes to provide for a shield to any creeping current. The device exhibits a narrow tubular structure of insulating material.

The previously mentioned problems of sensitivity and recovery have been addressed by the use of an electron donor on the electrode surfaces or elsewhere. This electron donor can comprise radioactive elements, such as tritium and/or toxic alkaline earth metals, such as barium. It is obvious, that this solution has specific drawbacks associated inter alia with the radioactivity and/or toxicity of the components.

THE OBJECT OF THE INVENTION

The object of the present invention is to make available gas discharge tubes for all relevant areas of application, said gas discharge tubes exhibiting in particular smaller dimensions compared to other gas discharge tubes showing the same efficiency with less volume, less weight and/or less consumption of raw materials.

This object is achieved by providing a new insulating ring design or any hollow shape, while maintaining the electrode gap distance.

DETAILED DISCLOSURE OF THE PRESENT INVENTION

In particular the invention relates to a insulating ring having an extended width compared to its height thereby providing a long distance to any possible creeping current. The gas discharge tube comprises at least two electrodes and at least one hollow insulator ring fastened to at least one of the electrodes, whereby the insulating ring has an extended length for a creeping current on at least one of the insulator surfaces facing inward and/or outward compared to its height thereby providing a long distance to any possible creeping current.

In a preferred embodiment the Insulator has a ratio between the total height h of the insulator and the total length L for a creeping current on at least one of the surfaces inside and/or outside <1:1.3, preferably the ratio h to L is 1:1.5, preferably 1:2, more preferably 1:2.5, still more preferably 1:3, and further preferably 1:5.

At a certain voltage of operation, the needed length for avoiding a creeping current on the surfaces on the outside and the inside can vary depending on different conditions, e.g. gas and pressure inside and outside the hermetically sealed component.

As used herein the term "ring" means any hollow configuration limited by a raised peripheral border. Thus the ring may take the form of a circle, oval, or polygonal, such as triangular, quadratic, pentagonal, hexagonal, heptagonal, and octagonal or the like.

As used herein the term "insulator" or "insulating means" means a body being non-conductive with regard to electrical currents. Such means are normally produced of aluminium oxide, other porcelain qualities, glass, plastic, composite material or other insulating material. High-voltage insulators used for high-voltage power transmission are made from glass, porcelain, or composite polymer materials. Porcelain insulators are made from clay, quartz or alumina and feldspar, and are covered with a smooth glaze to shed dirt. Insulators made from porcelain rich in alumina are used where high mechanical strength is a criterion. Glass insulators were (and in some places still are) used to suspend electrical power lines. Some insulator manufacturers stopped making glass insulators in the late 1960s, switching to various ceramic and, more recently, composite materials.

For some electric utilities polymer composite materials have been used for some types of insulators which consist of a central rod made of fibre reinforced plastic and an outer weathershed made of silicone rubber or EPDM. Composite insulators are less costly, lighter weight, and they have excellent hydrophobic capability. This combination makes them ideal for service in polluted areas. However, these materials do not yet have the long-term proven service life of glass and porcelain.

SHORT DESCRIPTION OF THE DRAWINGS

The invention will be described in closer detail below, with reference to the drawings, in which FIG. 1 shows a cross section of a first embodiment of a gas discharge tube with two electrodes according to the present invention;

DETAILED DESCRIPTION OF THE INVENTION

Figure 8:
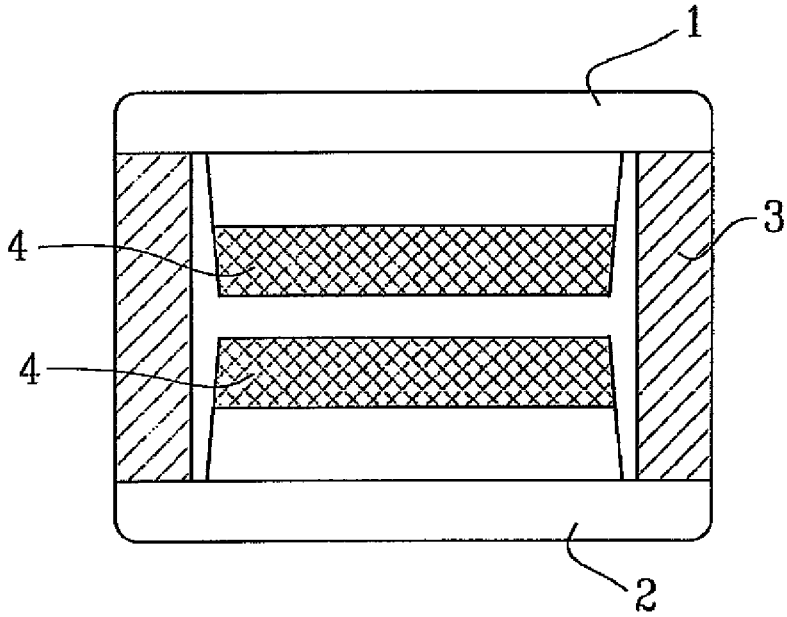
FIG. 8 shows a cross section of a gas discharge tube of the present prior art.

A generic gas discharge tube comprises at least two electrodes, joined to a hollow insulator body. One frequently encountered type of gas discharge tubes such as illustrated in FIG. 8 comprises two end electrodes 1 and 2, each electrode including a flange-like base part and at least one hollow cylindrical insulator 3, soldered or glued to the base part of the end electrodes. A coating or element, resistant to the build-up of layers, is illustrated as the screened area 4 on both electrodes. Regardless of the type of gas discharge tube, it is important that at least the cathode has such a coating layer or is of the material or construction, which is described below. It is, however, preferred that all electrodes have this layer or construction, as the polarity of the transient can vary. A normal dimension of a gas discharge tube e.g., for igniting high pressure xenon lamps, is an axial extension of about 6.2 mm, and a radial extension of 8 mm (diameter). Such a tube has an insulator ring with a height of 4.4 mm and can withstand a discharge of several kV using an electrode gap of 0.6 mm.

Figure 1:
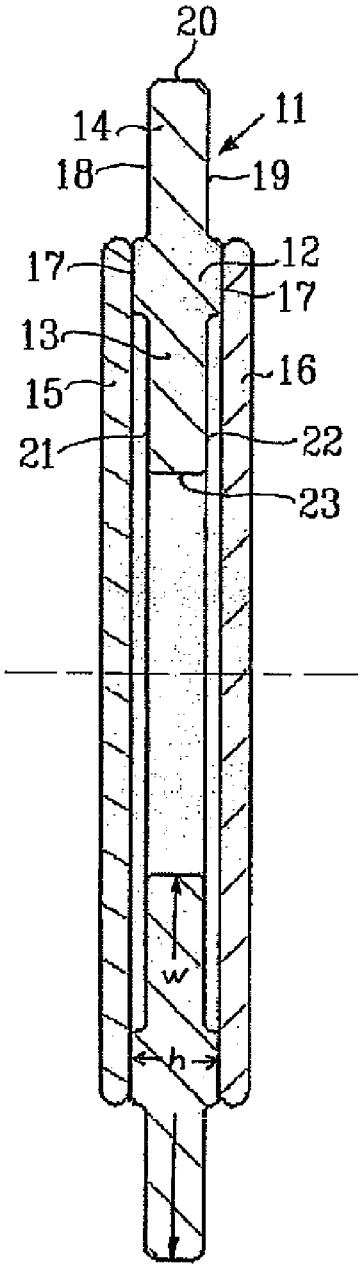

FIG. 1 shows a first embodiment of the present invention, wherein 11 denotes a ceramic ring taking any shape as defined above, known to possess electro insulating properties. The ring 11 comprises a cylindrical structure 12 from which radially extending flanges 13 and 14 extend inwardly and outwardly. Two electrodes 15 and 16 are attached by means of soldering to the end surfaces of the cylindrical part 12 of the ring. The electrodes 15 and 16 are normally made of copper, silver or gold, iron/nickel alloy, or have one or more of these metals upon their surfaces.

The insulating ring 11 comprises, as given above, a cylindrical part 12 having two planar, oppositely facing surfaces 17, which surfaces normally are preprepared to accept soldering metals, such as tin and tin alloys or hard soldering alloys. Further the ceramic ring 11 comprises one outwardly, radially extending flange 13 having two radially extending surfaces 18 and 19 forming an angle to the cylindrical part 12 and an edge, axially directed surface 20. On the inwardly facing side of the cylindrical part 12 of the ring 11 there is a second radially extending flange 14 having two radially extending surfaces 21 and 22 forming an angle to the cylindrical part 12 and an edge, axially directed surface 23.

The radially extending surfaces 18, 19, 21 or 22 may be perpendicular to the ring structure 11 or may form a blunt of pointed angle thereto. However, it is obvious that such a non-perpendicular angle is only slightly blunt or pointed. The angle α may thus be anything from 75 to 105°.

The total height h, see definition in FIG. 1, of the ring 11 is 0.6 mm, and the total height of the discharge tube including the electrodes is 1.0 mm using an electrode gap of 0.6 mm. The total length L, see definition in FIG. 5, (L is the sum of the bolded marked lengths of the cross-section facing inward) of the surfaces 21, 22 and 23 is 2.7 mm and or the total length of the surfaces 18, 19 and 20 is 2.7 mm, for a creeping current on at least one of the surfaces inside and/or outside. The ratio h:L<1:1, actually 1:4.7. The ratio h to L is a ratio between the total height h of the insulator and the total length L for a creeping current on at least one of the surfaces inside and/or outside <1:1.3, preferably the ratio h to L is 1:1.5, preferably 1:2, more preferably 1:2.5, still more preferably 1:3, and further preferably 1:5.

Another way of defining the invention is to use the width w of the ring defined as the distance between the outer edges of the flanges 13 and 14 and the height h. The ratio between h to w, is at least 1:2, preferably 1:3 to 5, preferably 1:3 to 10, more preferably at least 1:4 still more preferably at least 1:5.

Figure 2:
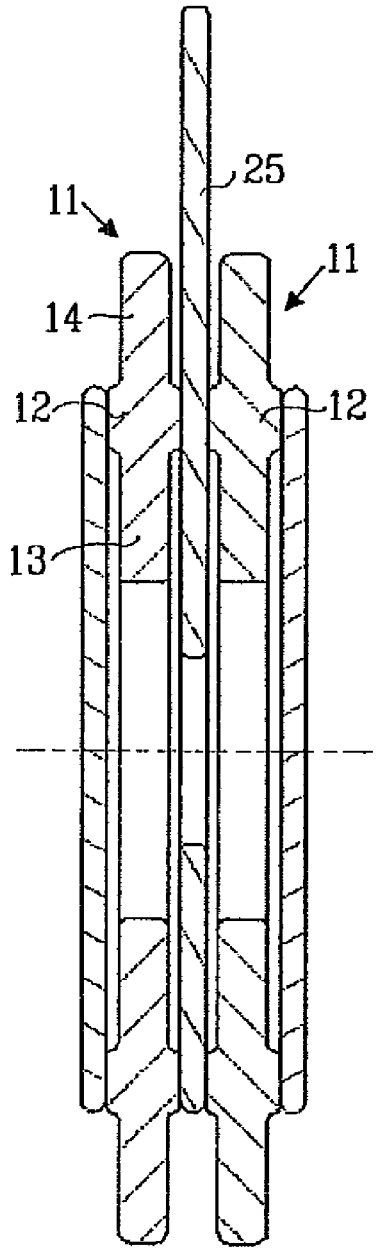
FIG. 2 shows a cross section of a second embodiment of a gas discharge tube with three electrodes according to the present invention.

FIG. 2 shows a multielectrode embodiment of the present invention, wherein a third electrode 25 is present. Here there is an assembly of electrodes and insulator rings 11, whereby the central electrode is annular and is common to the other two electrodes, i.e., the electrode 25 is fixed to two insulating rings 11.

Figure 3:
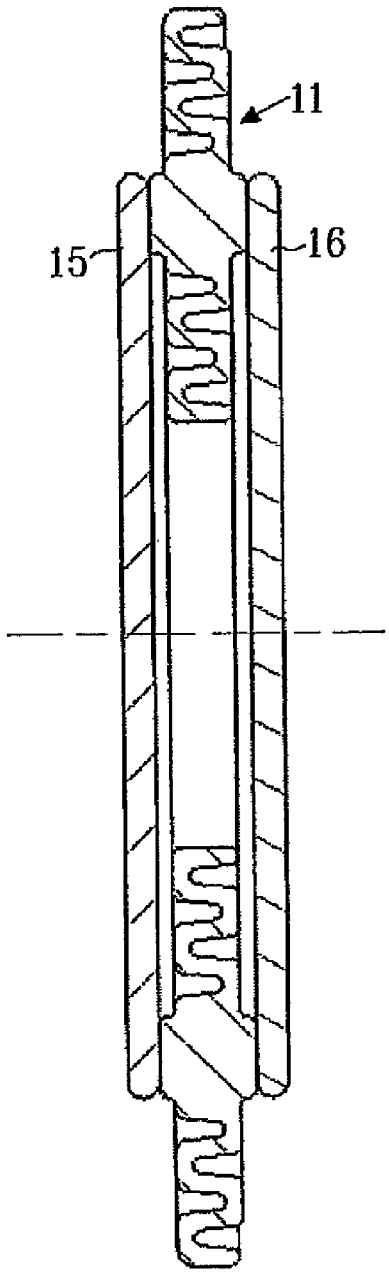
FIG. 3 shows a cross section of a third embodiment of a gas discharge tube with two electrodes according to the present invention.

FIG. 3 shows a further embodiment of the present invention, wherein the radially extending surfaces of the radially extending flanges have been modified to have a wave form or have ditches of any shape in order to further increase the pathway for any creeping current that may appear.

The radially extending flanges 13, 14 lengthens the way any creeping current has to move from one electrode to the other, and will in that respect more or less correspond to the way present on a regular insulator present in hitherto known gas discharge tubes.

Figure 4:
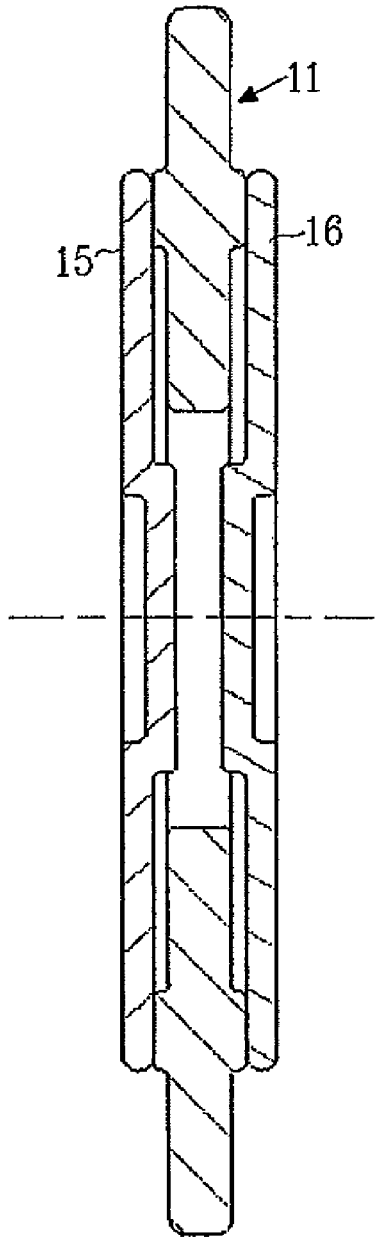
FIG. 4 shows a cross section of a forth embodiment of a gas discharge tube with two electrodes according to the present invention.

FIG. 4 shows a gas discharge tube similar to the one shown in FIG. 1, wherein, however, the gap between the electrodes has been narrowed by pressing the centre of the electrode below the general plane of the electrode.

Figure 5:
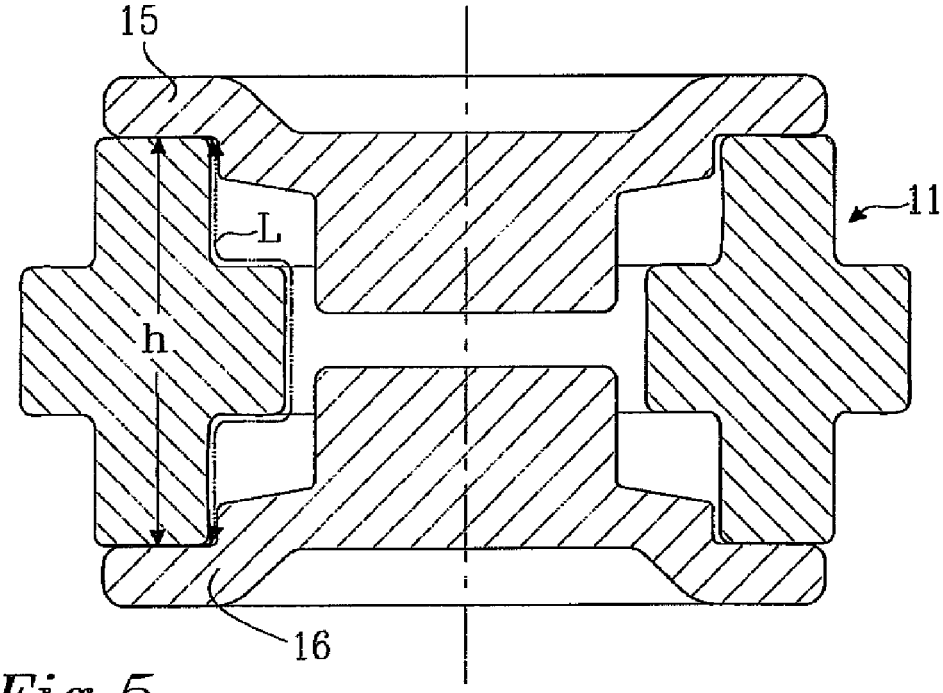
FIG. 5 shows a cross section of a fifth embodiment of a gas discharge tube with two electrodes according to the present invention.

FIG. 5 shows a further embodiment of the present invention, wherein an increase the pathway for any creeping current that may appear is done on the inside and outside of a component. The total final form of the gas discharge tube will then be more similar to the ones of today. The same definition appears here as above, whereby the L on the inside of the gas discharge tube will be the one calculated on.

Figure 6:
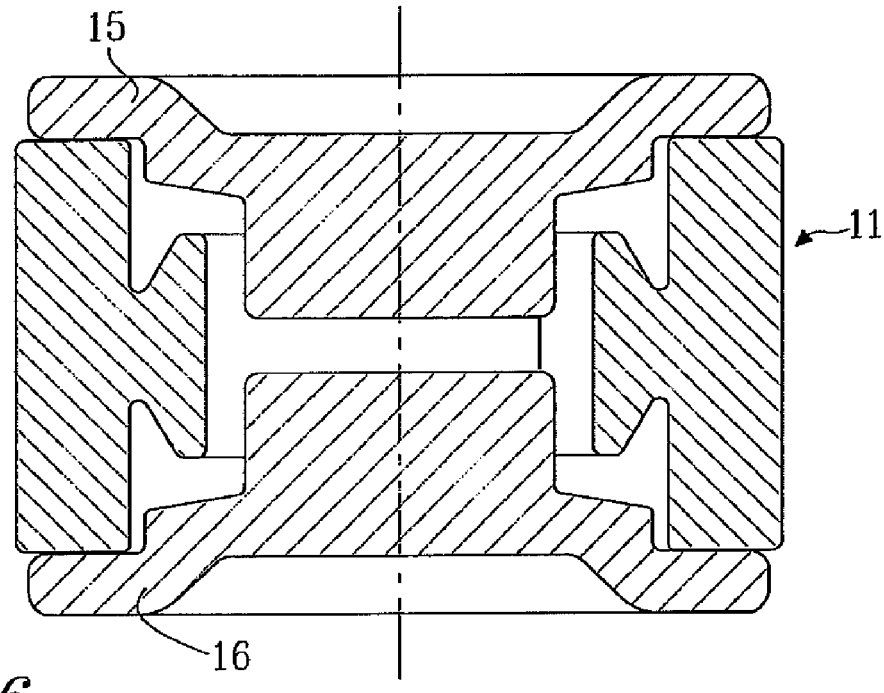
FIG. 6 shows a cross section of a sixth embodiment of a gas discharge tube with two electrodes according to the present invention.

FIG. 6 shows a further embodiment of the present invention, wherein an increase the pathway for any creeping current that may appear is done on the inside of a component The total final form of the gas discharge tube will then be more similar to the ones of today. The same definition appears here as above, whereby the L on the inside of the gas discharge tube will be the one calculated on.

Figure 7:
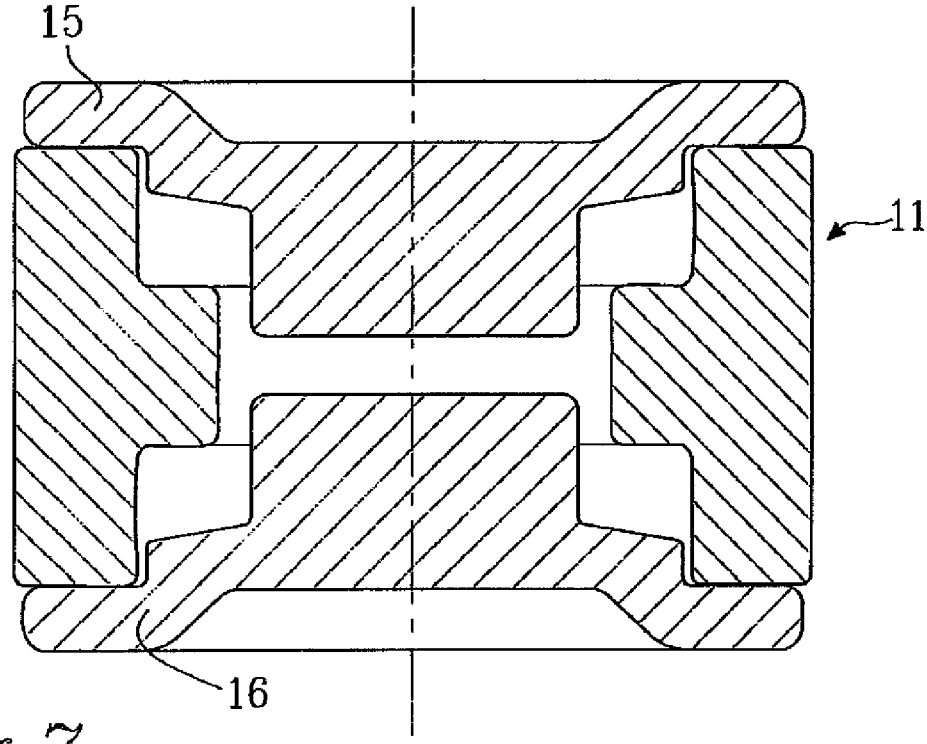
FIG. 7 shows a cross section of a seventh embodiment of a gas discharge tube with two electrodes according to the present invention.

FIG. 7 shows a further embodiment of the present invention, wherein an increase the pathway for any creeping current that may appear is done on the inside of a component. The total final form of the gas discharge tube will then be more similar to the ones of today. The same definition appears here as above, whereby the L on the inside of the gas discharge tube will be the one calculated on.

However, besides this feature the inwardly extending flange will also provide for a less conducting inner surface. Thus, during gas discharge sputtering of metal such as copper (if a copper electrode is used) may occur and this sputtered metal will condense on the walls of the tube. However, the inwardly extending flange showing an angle to the electrode surface will also create a shadow for the sputtered material which will hardly reach the surfaces 21 and 22. Thus the likelihood for building up of a conducting layer on the inside wall of the tube between the electrodes is very little, which further increases the operation life of such a discharge tube.

It is preferred, that at least part of the opposite surfaces of said end electrodes are covered with a layer or coating of a compound or element, resistant to the build-up of layers, such as oxide layers. Other unwanted layers, the formation of which the inventive concept aims to prevent, are for example hydrides. In general, the expression "unwanted layers" comprises any layers formed on the electrodes through interaction with surrounding compounds, such as gases contained in the gas discharge tube and which layers influence the performance of the tube.

This compound, which forms the inventive layer and is resistant to the build-up of unwanted layers, can be a highly stable metallic alloy, a metal such as titanium, or a practically inert element, such as gold. The compound can be a carbonaceous compound, preferably carbon with an addition of a metal, such as chromium or titanium.

In this context, carbon is defined as any polymorph of carbon, for example diamond, diamond-like carbon or graphite. The carbon may also contain other elements, such as one or several metals in amounts depending on the application, for example amounts up to about 15%.

Preferably, the opposite surfaces of said end electrodes are covered with a coating or layer of graphite, said layer comprising an addition of metal, such as chromium or titanium.

According to one embodiment thereof, the inert surface or oxidation resistant coating or layer is applied to the electrodes by chemical plating, sputtering or the like. Preferably, the oxidation resistant layer is applied by conventional sputtering or plasma deposition techniques, well known to a person skilled in the art.

The processes, applicable include chemical vapour deposition (CVD), physical vapour deposition (PVD) were a coating is deposited onto a substrate. Sputtering, which is a physical deposition process, is presently held to be the best applicable.

It is also possible, in the case of metallic coatings, to use electroplating procedures or so called electro less plating. These procedures are especially suitable for applying coatings consisting of precious metals, such as gold or platinum.

According to one embodiment, the surfaces of the electrodes may be only partially coated, e.g. on a small area in the direction of the opposite electrode.

As an alternative embodiment, a part of the electrode is made of the inert material, for example a carbonaceous body, fastened, for example sandwiched or sintered to a metallic base part of the electrode. It is conceived that the electrode can be manufactured as a metallic base, for example a copper or aluminium base, capped with or encasing a graphite body presenting at least one surface in the direction of the at least one opposing electrode.

Surge arresters with electrode surfaces according to the present invention exhibit lower arc voltages and a more narrow distribution of the static ignition voltage than present devices.

Further, the present invention offers a solution, which is easy to implement in existing surge arrester designs, and which is suitable for mass production. Additionally, the solution according to the present invention does not have any negative influence on the environment or require special waste handling procedures, in contrast to presently used surge arresters containing radioactive gas, such as tritium and/or toxic compounds, such as barium salts.

Gases used in gas filled surge arresters are i.a., nitrogen, helium, argon, methane, hydrogen, and others, as such or in mixtures.

The invention will be illustrated by a non-limiting production example, which describes the production of a surge arrester according to one embodiment of the invention.

Production Example

A surge arrester was produced by subjecting a batch of copper electrodes to the following treatment steps: first, the electrodes were rinsed in a solvent, removing loose contamination and traces of grease or fat. The electrodes and insulating rings were subject to vacuum, filled with a certain gas or a gas mix to a certain pressure and soldered to provide gas discharge tubes.

In case the electrodes are to be provided with a coating the electrodes are placed in a mask, exposing the area to be coated. A set of electrodes, cleaned and placed in a mask, were then introduced in a sputtering chamber, which was evacuated. The electrodes were then subjected to cleaning by reverse sputtering, removing impurities from the electrodes. The current was then reversed and methane led into the chamber. By supplying chromium in the form of chromium cathodes, a process of reactive sputtering was performed. The electrodes received a layer of graphite with an addition of chromium atoms locking the graphite layers. Finally, the sputtering process was terminated and the coated electrodes removed from the chamber and subjected to normal quality control.

The coated electrodes exhibited improved qualities, such as higher heat-resistance. Surge arresters manufactured using the coated electrodes exhibited improved qualities, such as lower arc-voltage, more narrow distribution of ignition voltages, and improved speed and selectivity, and longer life-cycle time.

Although the invention has been described with regard to its preferred embodiments, which constitute the best mode presently known to the inventors, it should be understood that various changes and modifications as would be obvious to one having the ordinary skill in this art may be made without departing from the scope of the invention which is set forth in the claims appended hereto.

The invention claimed is:

1. A gas discharge tube comprising:

at least two electrodes; and at least one hollow insulator coupled to at least one of the electrodes, said insulator having at least two opposite facing surfaces, wherein the insulator has an extended length L for a creeping current along at least one of the surfaces of the insulator height thereby providing a long distance to any possible creeping current, and wherein the total height h of the insulator is less than the extended length L, whereby the ratio h to L is in the range of 1:1.5 to 1:5, and whereby the ratio between h to w, w being the width of the insulator as defined as the distance between the outer edges of insulator flanges, is from 1:2 to 1:10.

2. The gas discharge tube according to claim 1, wherein the ratio h:w is between 1:3 and 1:5.

3. The gas discharge tube according to claim 1, wherein the ratio h:w is between 1:4 and 1:5.

4. The gas discharge tube according to claim 1, wherein the insulator comprises a cylindrical part having two planar, oppositely facing surfaces, further the insulator comprises one outwardly, radially extending flange having two radially extending surfaces and forming an angle to the cylindrical part and an edge, axially directed surface, the insulator further comprises on the inwardly facing side of the cylindrical part of the insulator a second radially extending flange having two radially extending surfaces and forming an angle to the cylindrical part and an edge, axially directed surface.

5. The gas discharge tube according to claim 4, wherein it consists of two or more electrode assemblies, each comprising an insulator.

6. The gas discharge tube according to claim 5, wherein one or more electrode assemblies have an axial extension.

7. The gas discharge tube according to claim 4, wherein one or both radially extending flanges are wave formed.

8. The gas discharge tube according to claim 4, wherein one or both radially extending flanges are provided with ditches.

9. The gas discharge tube according to claim 1, wherein said at least two electrodes have a chemically inert surface.

10. The gas discharge tube according to claim 1, wherein the at least two electrodes have an inert surface, which inert surface is resistant to the build-up of unwanted layers formed on the electrodes through interaction with surrounding compounds, such as gases contained in the gas discharge tube and which layers influence the performance of the tube.

11. The gas discharge tube according to claim 10, wherein the inert surface is resistant to any formation of oxide or hydride layers.

12. The gas discharge tube according to claim 1, wherein at least one surface of said electrodes is/are covered with a coating of a compound, resistant to the build-up of layers, such as oxide layers.

13. The gas discharge tube according to claim 12, wherein said coating comprises carbon.

14. The gas discharge tube according to claim 13, wherein said coating comprises graphite.

15. The gas discharge tube according to claim 1, wherein at least one electrode further comprises an element of chromium or titanium.

16. The gas discharge tube according to claim 1, wherein at least one of the electrodes is made of a material resistant to the build-up of layers, such as oxide and hydride layers.

* * * * *